US012514311B1

(12) United States Patent
Caldwell

(10) Patent No.: US 12,514,311 B1
(45) Date of Patent: Jan. 6, 2026

(54) GLOVE WITH DEPLOYABLE KNIFE

(71) Applicant: Austin Caldwell, Pleasant Hills, PA (US)

(72) Inventor: Austin Caldwell, Pleasant Hills, PA (US)

( * ) Notice: Subject to any disclaimer, the term of this patent is extended or adjusted under 35 U.S.C. 154(b) by 50 days.

(21) Appl. No.: 17/955,265

(22) Filed: Sep. 28, 2022

Related U.S. Application Data

(60) Provisional application No. 63/249,179, filed on Sep. 28, 2021.

(51) Int. Cl.
*A41D 19/015* (2006.01)
*A41D 19/00* (2006.01)
*F41B 13/06* (2006.01)
*F41B 13/00* (2006.01)

(52) U.S. Cl.
CPC ..... *A41D 19/0024* (2013.01); *F41B 13/06* (2013.01)

(58) Field of Classification Search
CPC ..... F41B 13/06; F41B 15/06; A41D 19/0024; A41D 19/01511; A41D 27/205; A41D 19/002; B26B 21/4075; B26B 27/007; B26B 21/527; B26B 29/08; B26B 29/00; B26B 19/38; B26B 5/003; B26B 5/001; A47J 17/02
USPC ..... 30/152, 298; 2/158–170
See application file for complete search history.

(56) References Cited

U.S. PATENT DOCUMENTS 737,539 A * 8/1903 Weidman ..... B26B 27/007 30/298
845,792 A * 3/1907 Jenkins ..... B26B 1/08 30/162
1,315,503 A * 9/1919 Hughes ..... B26B 1/046 30/298
1,594,151 A * 7/1926 Chance ..... A41D 13/084 30/298
2,352,921 A * 7/1944 Stoltz ..... F41B 15/00 30/296.1
2,353,557 A * 7/1944 Guthrie ..... B26B 27/007 30/298
2,665,478 A * 1/1954 Clemens ..... F41B 13/00 30/162
3,060,625 A * 10/1962 Glass ..... F41C 9/00 224/267

(Continued)

FOREIGN PATENT DOCUMENTS

CN 202399280 U 8/2012
CN 202800018 U 3/2013

OTHER PUBLICATIONS

Glove fish scale knife. Patent Translation [online]. Google Patents [retreived on Sep. 12, 2019]. Retrieved from the Internet: <URL: https://patents.google.com/patent/CN202800018U/en?q=glove&q=knife&oq=glove+knife>.

(Continued)

*Primary Examiner* — Robert H Muromoto, Jr.

(74) *Attorney, Agent, or Firm* — Cramer Patent & Design, PLLC.; Aaron R. Cramer

(57) ABSTRACT

A glove with deployable spring-loaded knife comprises a glove being made of cut resistant chain mail having a wrist portion and knife housing. The knife housing is capable of being secured about the wrist portion of the device. Within the knife housing resides a kitchen quality carbon steel grade knife which may be deployed through actuation of a spring-loaded mechanism and switch.

1 Claim, 5 Drawing Sheets

(56) References Cited

U.S. PATENT DOCUMENTS 4,004,295 A 1/1977 Byrnes, Sr.
4,096,629 A * 6/1978 Levine ..... F41B 15/00 30/162
4,388,733 A 6/1983 Anstett
4,523,379 A * 6/1985 Osterhout ..... B26B 29/025 30/162
4,660,287 A * 4/1987 Decker ..... A61B 17/3213 30/162
4,807,362 A * 2/1989 Prentice ..... F41B 15/00 30/155
5,058,278 A * 10/1991 Colvin ..... F41B 15/00 30/298
5,088,121 A * 2/1992 Wallace ..... B65D 83/384 2/163
5,095,547 A * 3/1992 Kerns ..... A41D 19/01594 2/163
5,275,068 A * 1/1994 Wrench ..... B26B 27/007 30/296.1
5,301,432 A * 4/1994 Richardson ..... B26B 27/007 30/291
5,325,596 A * 7/1994 Baker ..... B26B 27/007 30/304
5,330,492 A * 7/1994 Haugen ..... A61B 17/3211 30/162
5,423,843 A * 6/1995 Werner ..... A61B 17/3211 30/162
5,454,380 A * 10/1995 Gates ..... A41D 19/01588 128/845
5,569,282 A * 10/1996 Werner ..... A61B 17/3211 30/162
5,647,130 A * 7/1997 Collins ..... B26B 29/025 30/162
5,722,169 A * 3/1998 Ozden ..... F41B 13/06 30/162
5,894,602 A * 4/1999 Smith ..... A41F 1/06 2/167
6,122,828 A * 9/2000 Asterino, Jr. ..... B26B 3/06 30/286
7,237,272 B2 * 7/2007 Botcher ..... A41D 31/24 2/259
7,305,769 B2 * 12/2007 McHenry ..... B26B 1/08 30/162
7,797,838 B2 * 9/2010 Chu ..... B26B 1/10 30/162
8,413,265 B1 * 4/2013 Hoppes ..... A41D 19/0037 2/160
9,051,744 B1 * 6/2015 Murray ..... E04F 21/04
9,091,504 B2 * 7/2015 McDonald ..... F41B 15/06
9,095,202 B1 8/2015 Vanheteren
9,289,904 B2 3/2016 Hawk et al.
9,676,105 B2 * 6/2017 McChesney ..... B26B 1/08
10,161,710 B2 12/2018 Rivera
10,207,424 B2 2/2019 Groeneweg et al.
10,264,872 B2 * 4/2019 Kim ..... A45F 5/00
10,300,615 B2 * 5/2019 Votolato ..... B26B 3/08
10,617,967 B1 * 4/2020 Oxenford ..... A63H 33/009
10,836,061 B2 * 11/2020 Fisher ..... F41B 13/00
10,870,213 B2 * 12/2020 Hogg ..... B26B 1/08
11,129,465 B1 * 9/2021 Goslin ..... F21V 21/145
11,745,372 B1 * 9/2023 Truyenque ..... B26B 21/4075 2/160
D1,066,557 S * 3/2025 Haughton ..... D22/118
2006/0207102 A1 * 9/2006 Bezold ..... B26B 1/08 30/162
2007/0175045 A1 * 8/2007 McHenry ..... B26B 1/08 30/162
2008/0282547 A1 * 11/2008 Leger ..... B26B 5/001 30/162
2010/0236077 A1 * 9/2010 Shirey ..... B26B 1/02 2/160
2010/0251552 A1 * 10/2010 Gazcon ..... B26B 1/08 30/162
2012/0304471 A1 * 12/2012 Jones ..... B26B 27/007 30/162
2013/0174423 A1 * 7/2013 Liao ..... B26B 5/001 30/162
2015/0328791 A1 * 11/2015 Jones ..... B26B 3/08 30/162
2015/0352732 A1 * 12/2015 Levine ..... B26B 1/08 30/151
2016/0286945 A1 * 10/2016 Kim ..... B25F 1/04
2017/0334084 A1 * 11/2017 Hogg ..... B26B 1/08
2019/0184588 A1 * 6/2019 Keelan ..... B26B 27/005
2019/0351570 A1 * 11/2019 Siffermann ..... B26B 3/06

OTHER PUBLICATIONS

Kitchen knife with glove. Patent Translation [online]. Google Patents [retreived on Sep. 12, 2019]. Retrieved from the Internet: <URL: https://patents.google.com/patent/CN202399280U/en?q=glove&q=knife&oq=glove+knife>.

* cited by examiner

GLOVE WITH DEPLOYABLE KNIFE

RELATED APPLICATIONS

The present invention is a continuation of U.S. Provisional Application No. 63/249,179 filed on Sep. 28, 2021, the entire disclosures of which are incorporated herein by reference.

FIELD OF THE INVENTION

The present invention relates to a glove with a deployable knife.

BACKGROUND OF THE INVENTION

In today's age, it is not always a good idea to let your guard down. There are too many instances of random acts of violence to enable people to always feel safe when walking around in public. Other times, even in the sanctity of one's own home, can violence occur. Therefore, a need arises in where an individual can access a weapon to defend themselves in a safe, rapid, and reliable manner.

However, openly carrying a weapon to declare is not always legal, depending on whatever jurisdiction an occurrence happens in. There are many instances of concealing weapons that have been devised over the years, although other jurisdictions may find that unlawful. Other times, the deployment of such a weapon from a concealed area may not be as safe and rapid as hoped. Furthermore, if an individual that wants to have such a weapon on hand and may have a medical condition that requires them, there are not a lot of products on the market that can allow those individuals to access their weapon in a safe, rapid, and reliable way. The present invention fulfills these needs.

SUMMARY OF THE INVENTION

The principles of the present invention provide for a glove and knife combination device which has a glove portion which in turn has a hand portion and a forearm portion configured to extend along the forearm of a wearer. The glove portion includes a protective material configured to protect the hand of the wearer and is configured to prevent one or more slashes and reduces blunt force damage.

The protective material may be chain mail. The chain mail may surround the hand of the wearer. The hand portion may include one or more glove straps configured to provide support to the hand of the wearer. The one or more glove straps may be attached with the hand portion to stiffen the protective material. The hand portion may include a plate configured to reinforce the hand portion, provide stabilization for the knife, and provide added protection to the wearer.

The plate may be made of metal. The plate may be made of plastic. The forearm portion may include a knife attachment that includes at least one forearm strap configured for disposal about the wrist of the wearer. The knife attachment may be connectable with the at least one forearm straps portion by an actuator. The actuator may be a spring-loaded button. The knife attachment may include a sheath for full concealment of the knife attachment when not deployed. The knife attachment may be quickly released by a knife deployment actuation means to extend the knife attachment from its fully concealed state to a fully deployed state.

The opposite end of the linkage mechanism may be mechanically coupled to the knife deployment actuation means. The knife attachment may extend along the back of the wearer's wrist along the back of the hand of the wearer. The knife attachment may be restrained along a knife deployment travel path by a plurality of guide blocks. A knife gate may move along a motion path to permit egress of the knife attachment that is enabled by a linkage mechanism operating on a fulcrum point. An automatic return of the knife attachment may be made of 1060 carbon steel. The knife attachment may be made of 1095 carbon steel.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
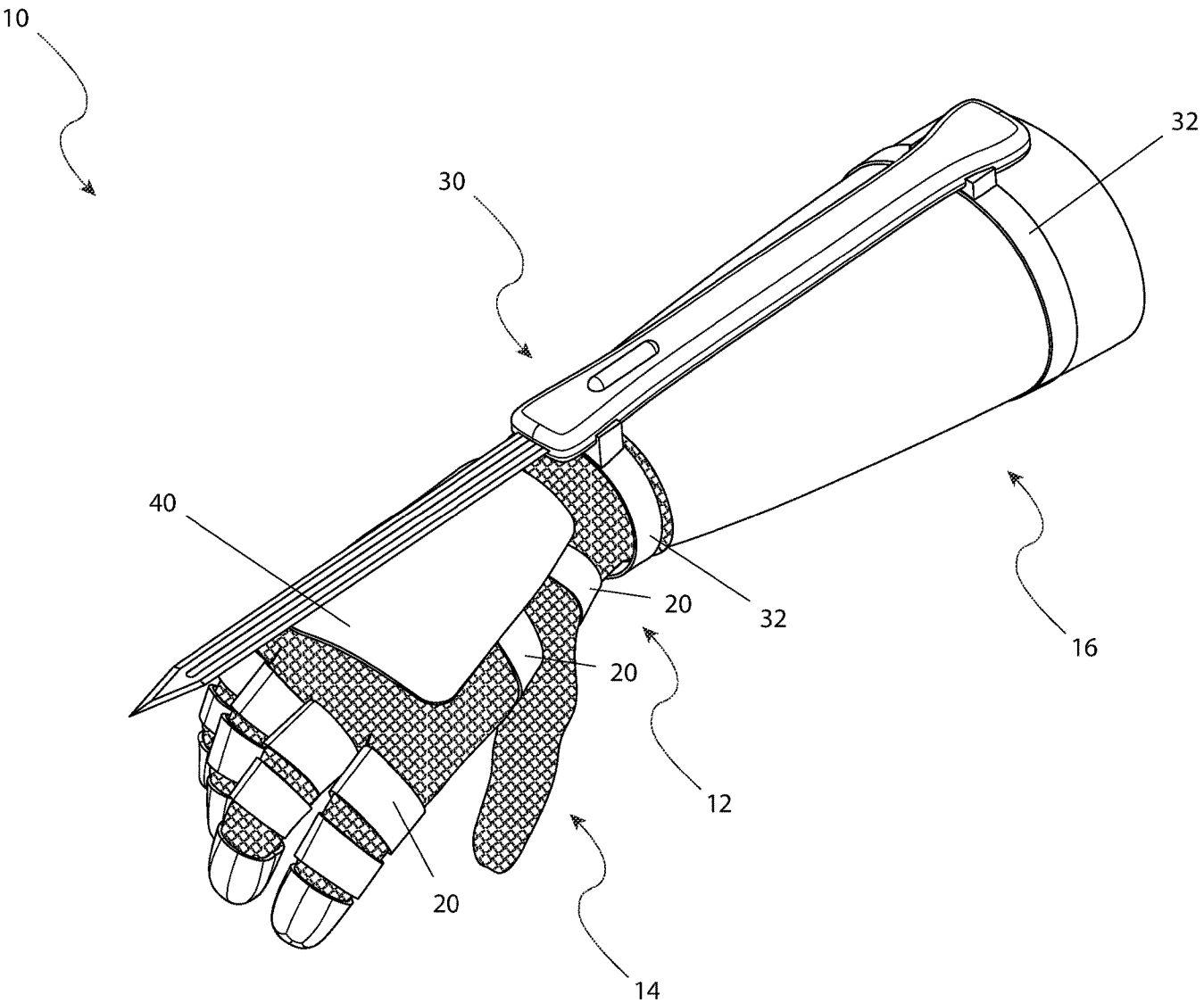
FIG. 1 is a front perspective view a glove and knife combination device 10, according to the preferred embodiment of the present invention.

10 glove and knife combination device
12 glove portion
14 hand portion
16 forearm portion
20 glove strap
30 knife attachment
32 forearm strap
34 knife deployment actuation means
36 sheath
38 knife
40 plate
50 knife deployment travel path "k"
55 guide blocks
60 knife spring
65 knife gate
70 motion path "m"
75 linkage mechanism
80 fulcrum point
85 knife gate spring
90 knife retraction travel path "r"

1. Description of the Invention

The best mode for carrying out the invention is presented in terms of its preferred embodiment, herein depicted within FIG. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

The following disclosure is provided to describe various embodiments of a glove and knife combination device 10. The device 10 is worn such that the knife 38 extends along the back of a hand of a wearer. Skilled artisans will appreciate additional embodiments and uses of the present invention that extend beyond the examples of this disclosure. Terms included by any claim that may be presented in any yet-to-be-filed non-provisional patent application are to be interpreted as defined within this disclosure. Singular forms should be read to contemplate and disclose plural alternatives. Similarly, plural forms should be read to contemplate and disclose singular alternatives. Conjunctions should be read as inclusive except where stated otherwise.

Expressions such as "at least one (1) of A, B, and C" should be read to permit any of A, B, or C singularly or in combination with the remaining elements. Additionally, such groups may include multiple instances of one or more element in that group, which may be included with other elements of the group. All numbers, measurements, and values are given as approximations unless expressly stated otherwise.

Figure 2:
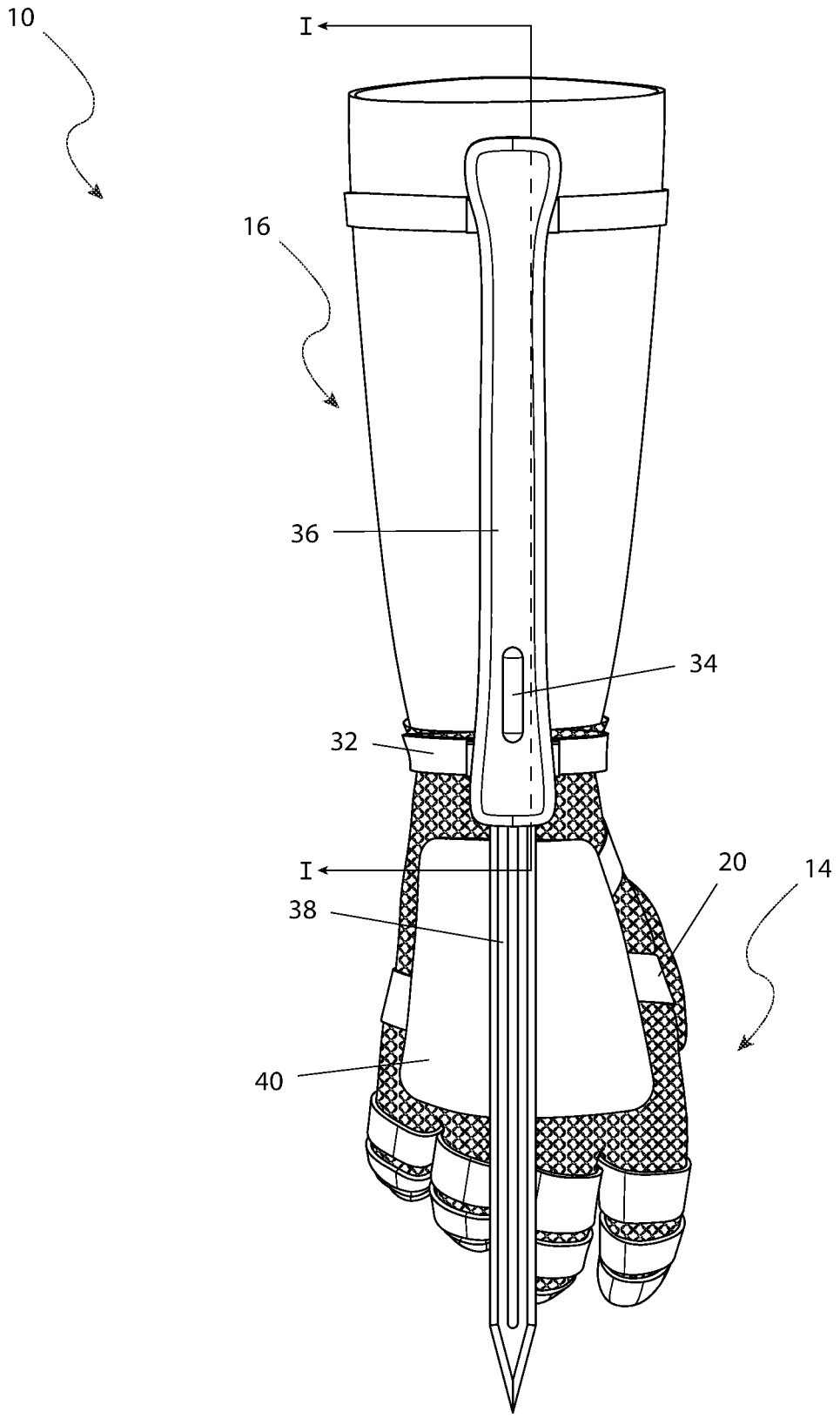
FIG. 2 is a top plan view of the glove and knife combination device 10, wherein a knife 38 is deployed, according to the preferred embodiment of the present invention.
Figure 3:
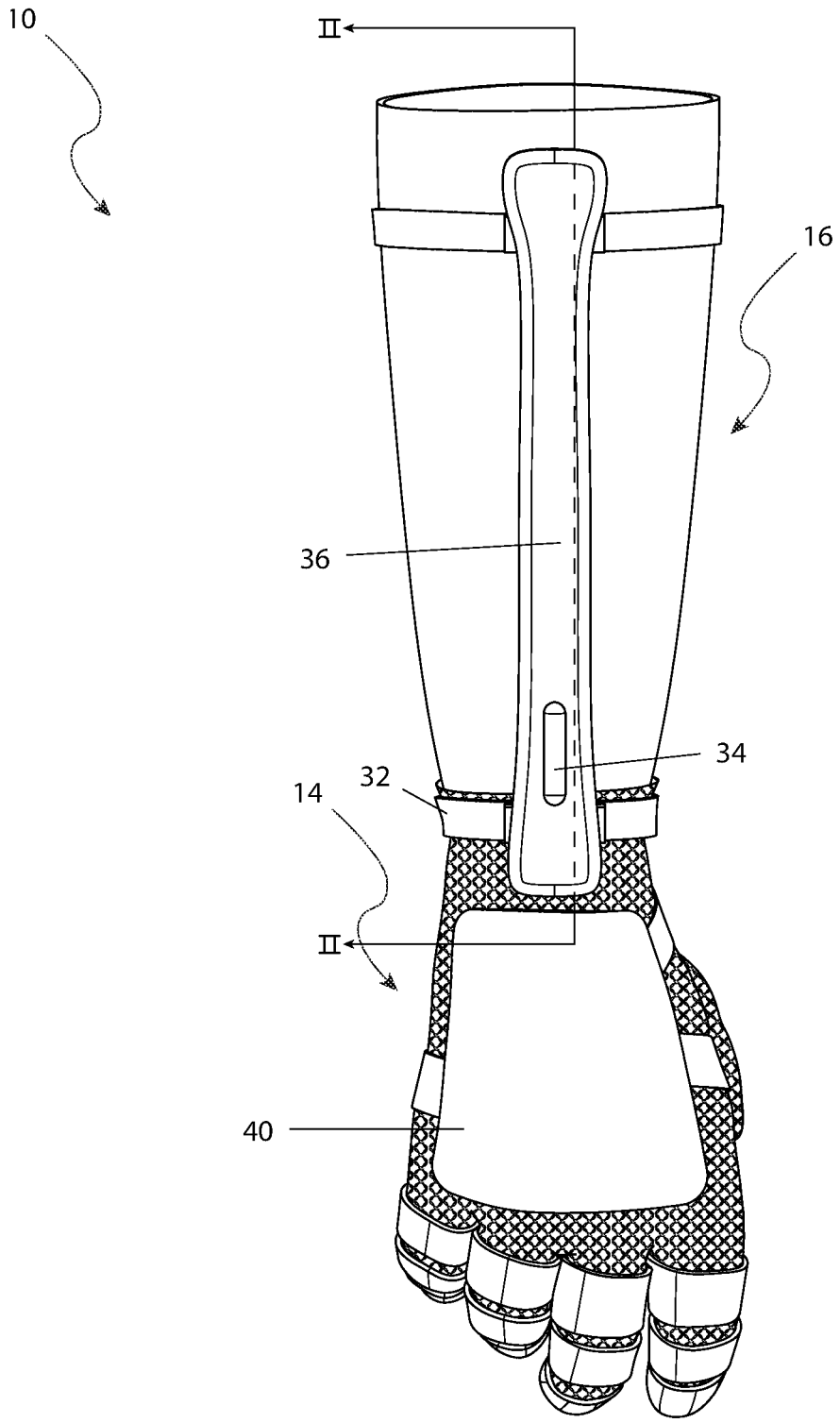
FIG. 3 is a top plan view of the glove and knife combination device 10, wherein the knife 38 is not deployed, according to the preferred embodiment of the present invention.

Various aspects of the present disclosure will now be described in detail, without limitation. Skilled readers should not view the inclusion of any alternative labels as limiting in any way. Referring now to FIGS. 1-3, an illustrative glove and knife combination device 10 will now be discussed in more detail.

The device 10 includes a glove portion 12. In some embodiments, the glove portion 12 includes a hand portion 14 and a forearm portion 16 configured to extend along a forearm of the wearer. In some embodiments, the glove portion 12 includes a protective material configured to protect the hand, for example, chain mail. The chain mail is formed of a plurality of small metal rings that are linked together to form a mesh material. The chain mail surrounds the hand portion 14. The protective material is configured to protect the wearer from injury during use. For example, the protective material is configured to prevent slashes and can reduce the effect of blunt force damage as well. In some embodiments, the protective material may be ring mesh, metal, Teflon®, ultra-high-molecular-weight polyethylene, thermoplastic polyethylene or pre-preg aramid fibers, or various other materials.

The hand portion 14 includes one (1) or more glove straps 20 configured to provide support to the hand portion 14. The glove straps 20 are attached with the hand portion 14 at specific locations to stiffen the protective material.

The forearm portion 16 includes a knife attachment 30. The knife attachment 30 includes at least one (1) forearm strap 32 configured for disposal about the wrist. The knife attachment 30 is connectable with the forearm straps 32 portion by an actuator, for example, a spring-loaded button. The knife 38 includes a sheath 36 for full concealment of the knife 38 when not deployed. The knife 38 can be quickly released by a knife deployment actuation means 34 to extend the knife 38 from its fully concealed state to a fully deployed state, as shown in FIGS. 2 and 3. The knife 38 extends along the back of the wearer's wrist along the back of the hand. The knife 38 includes a metal material, for example 1060 carbon steel or 1095 carbon steel. The knife 38 extends from the wrist along the back of the wearer's hand. In some embodiments, the hand portion 14 includes a plate 40 configured to reinforce the hand portion 14, provide stabilization for the knife 38, and provide added protection to the wearer. In some embodiments, the plate 40 can include metal, plastic or other suitable material.

Figure 4:
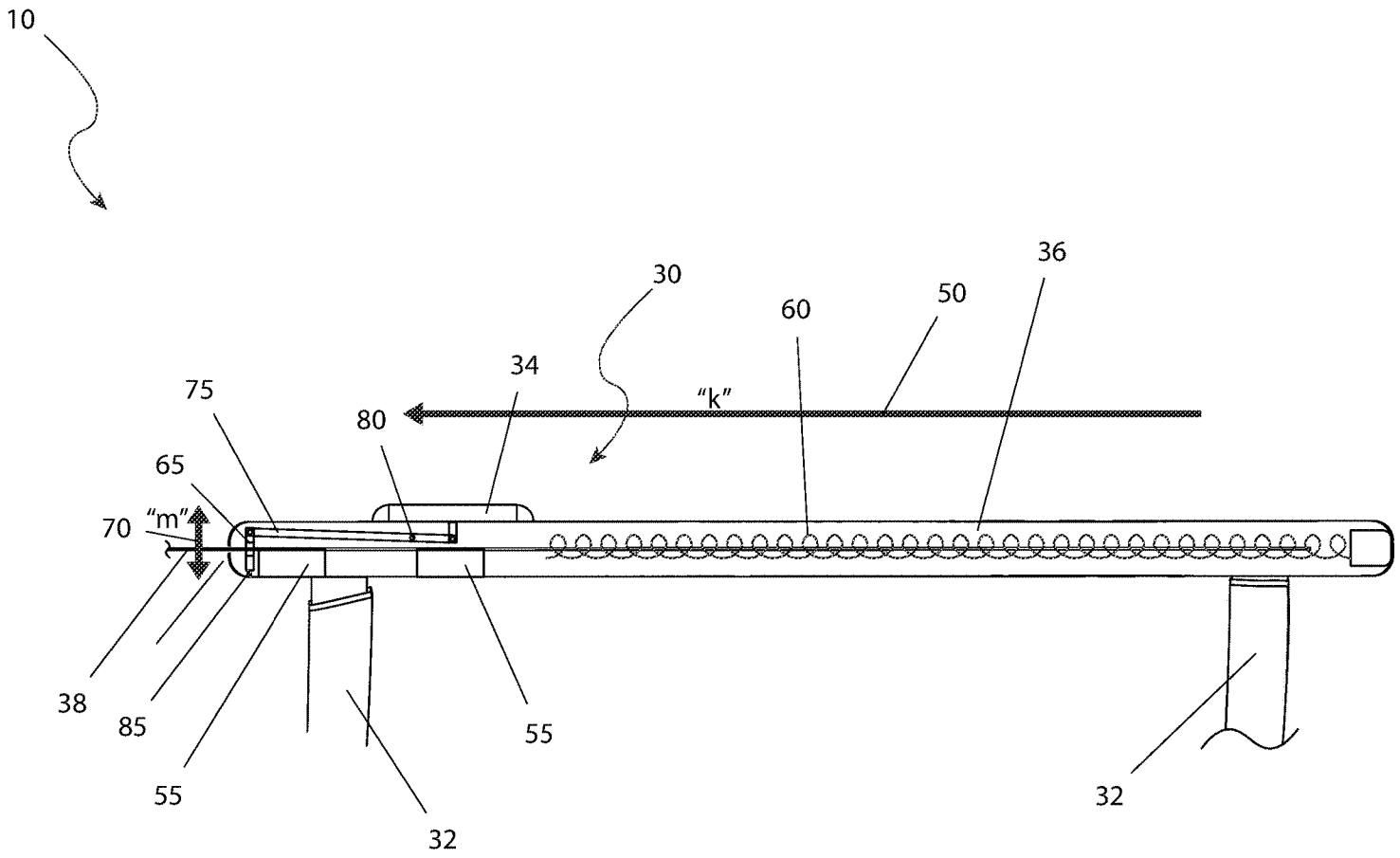
FIG. 4 is a sectional view of the glove and knife combination device 10, as seen along a line I-I, as shown in FIG. 2; and, FIG. 5 is a sectional view of the glove and knife combination device 10, as seen along a line II-II, as shown in FIG. 3.

Referring now to FIG. 4, a sectional view of the device 10, as seen along a line I-I, as shown in FIG. 2 is shown. The knife attachment 30, includes the sheath 36 as well as one or more forearm straps 32, as aforementioned described. The knife 38 is restrained along a knife deployment travel path "k" 50 by two (2) or more guide blocks 55. The knife 38 is actively driven along the knife deployment travel path "k" 50 via a knife spring 60. A knife gate 65 moves along a motion path "m" 70 to permit egress of the knife 38. The motion path "m" 70 is enabled by a linkage mechanism 75 operating on a fulcrum point 80. The opposite end of the linkage mechanism 75 is mechanically coupled to the knife deployment actuation means 34. Automatic return of the linkage mechanism 75 is provided by a knife gate spring 85 operating on the knife gate 65.

Figure 5:
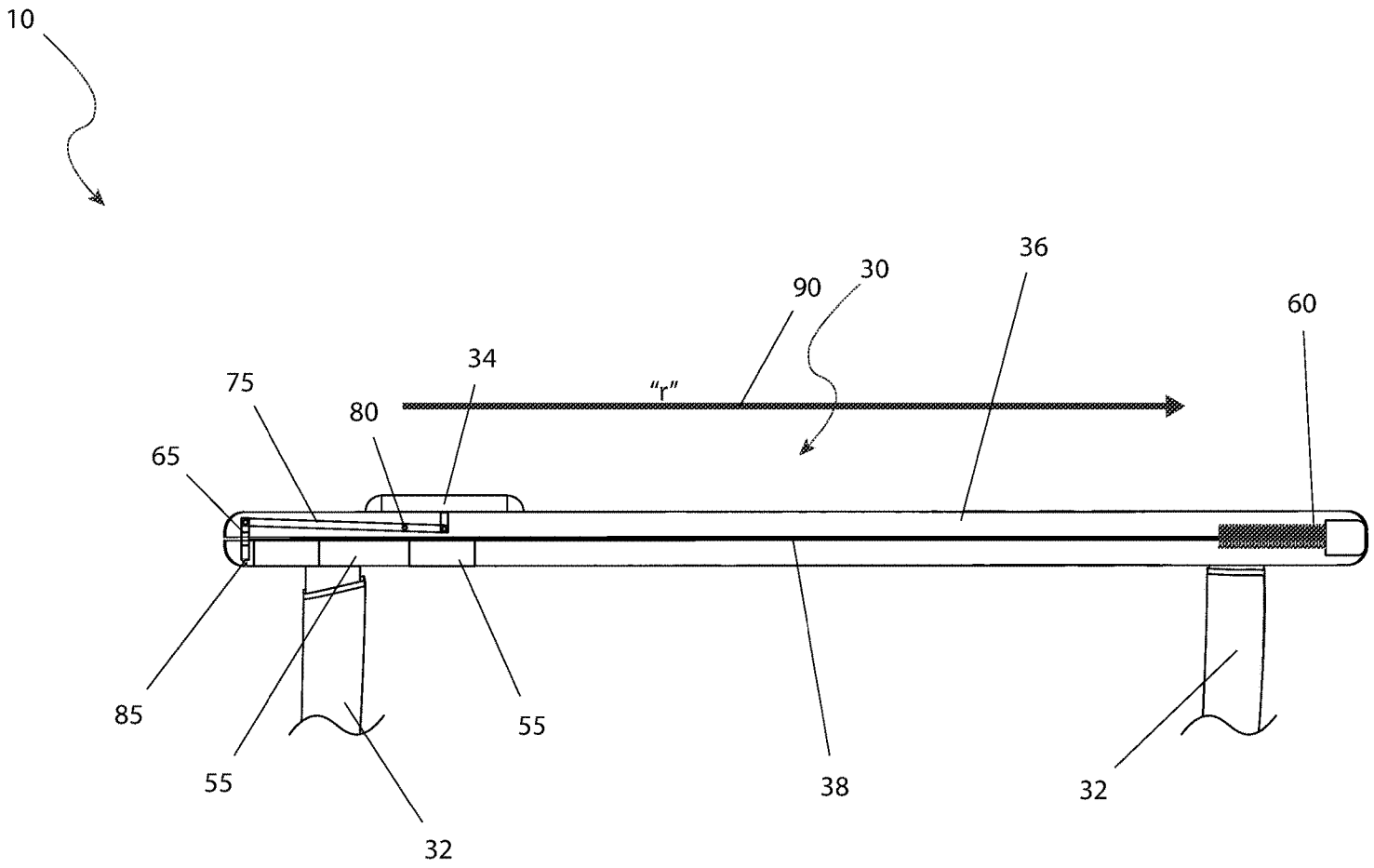

Referring now to FIG. 5, a sectional view of the device 10, as seen along a line II-II, as shown in FIG. 3 is disclosed. As before, the knife attachment 30, the sheath 36, and the forearm straps 32, are present. The knife 38 is completely enclosed within the sheath 36. During retraction, (as shown in the transition from FIG. 4 to FIG. 5), the user manually presses the knife 38 into the sheath 36 along a knife retraction travel path "r" 90. Once fully retracted, the knife gate 65 will engage the distal end of the knife 38 and hold in it place. The knife gate 65 is in turn held in place via the knife gate spring 85. As such, the knife gate 65 remains in tension with the linkage mechanism 75, using the fulcrum point 80, along with the knife deployment actuation means 34. The knife spring 60 is not in a compressed state to provide the energy for future deployment as shown in FIG. 4. The guide blocks 55 also hold the distal end of the knife 38 in alignment for future deployment through the knife gate 65.

In operation, the user inserts their hand into the glove portion 12 such that the hand portion 14 encloses the user's hand and the forearm portion 16 extends over the user's forearm. The forearm straps 32 are connected about the user's wrist to fit comfortable, as well as the glove straps 20. The knife attachment 30 removably attaches the sheath 36 of the knife 38 to the forearm straps 32. The wearer can then selectively deploy the knife 38 by actuating the knife deployment actuation means 34, and subsequent movement of the linkage mechanism 75 about the fulcrum point 80 which releases the knife gate 65 and is propelled forward via the knife spring 60.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A glove and knife combination device consisting of:

a glove portion including a hand portion and a forearm portion configured to extend along a forearm of a wearer;

the hand portion consisting of protective material formed of interlinked metal rings surrounding the hand of the wearer, the protective material configured to prevent slashes and reduce blunt-force damage;

the hand portion further consisting of a plate positioned beneath the back surface of the hand and beneath a portion of a knife when the knife is in a deployed position, the plate configured to reinforce the hand portion and stabilize the knife; and, the forearm portion consisting of at least one forearm strap configured for disposal about a wrist of the wearer and a knife attachment mounted on a dorsal side of the forearm and aligned longitudinally with the back of the hand; and, the knife attachment consisting of a sheath providing full concealment of the knife when not deployed, a knife gate at a distal end of the sheath defining an egress opening oriented along a longitudinal axis coincident with the back of the hand and forearm, a knife deployment actuation means positioned adjacent the forearm strap, a linkage mechanism extending between the knife deployment actuation means and the knife gate, a fulcrum point about which the linkage mechanism pivots, a knife spring biasing the knife for movement along a deployment travel path from a fully concealed state within the sheath to a fully deployed state extending over the back of the hand, and a knife gate spring operating on the knife gate to automatically return the knife to the fully concealed state after use; and, the knife guided by a plurality of guide blocks disposed within the sheath, the knife positioned such that in the fully deployed state the blade extends outwardly and forwardly along the dorsal surface of the hand with a cutting edge oriented substantially parallel to the longitudinal axis of the forearm.

* * * * *